United States Patent [19]

Simpson

[11] Patent Number: 4,473,981

[45] Date of Patent: Oct. 2, 1984

[54] SILL CLIP

[76] Inventor: Norbert E. Simpson, 9650 Poundstone Pl., Englewood, Colo. 80111

[21] Appl. No.: 220,518

[22] Filed: Dec. 29, 1980

[51] Int. Cl.[3] ..... E06B 1/04

[52] U.S. Cl. ..... 52/211; 52/714

[58] Field of Search ..... 52/214, 712, 714, 715, 52/211

[56] References Cited

U.S. PATENT DOCUMENTS

| | | | |
|---|---|---|---|
| 1,889,770 | 12/1932 | Black | 52/712 |
| 2,916,113 | 12/1959 | Lee | 52/712 X |
| 3,189,137 | 6/1965 | Harris | 52/714 X |
| 3,341,994 | 9/1967 | Olson | 52/712 X |

*Primary Examiner*—Carl D. Friedman

*Attorney, Agent, or Firm*—E. L. Spangler, Jr.

[57] ABSTRACT

This invention relates to a spring clip for biasing window sills up against the lower edge of a window sash either before or after the drywall has been installed, such clip being characterized by a horizontally-disposed leg fastenable to the underside of the sill, a spring finger depending from the front edge of the horizontal leg and extending rearwardly therefrom in acute angular relation, an upturned foot on the rear end of the spring finger, and means for fastening the sill and clip to the rearwardly-facing interior wall surface so as to hold the rear edge of the sill down in opposition to the bias exerted thereon by the clip. In versions of the clip designed for use with precast ceramic sills, a vertically-disposed integral leg depends from the rear end of the horizontal leg and fastening means, both integral and independent, are used to attach the vertical leg to the frame member in front thereof so as to leave a space for insertion of the drywall panel between it and the face-flange of the sill. In the drywall version, the vertically-disposed leg is elongated to extend beneath the face-flange of the sill. Still another version eliminates the vertical leg altogether and substitutes therefor a toothed clip embedded in the face-flange of the sill.

5 Claims, 10 Drawing Figures

Fig.-5
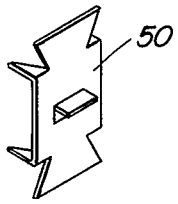
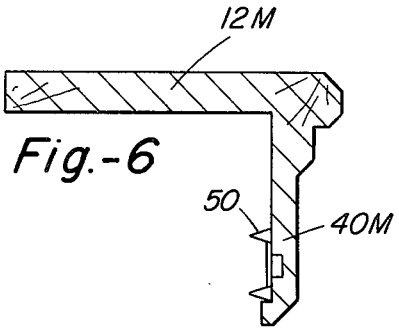
Fig.-6
Fig.-7
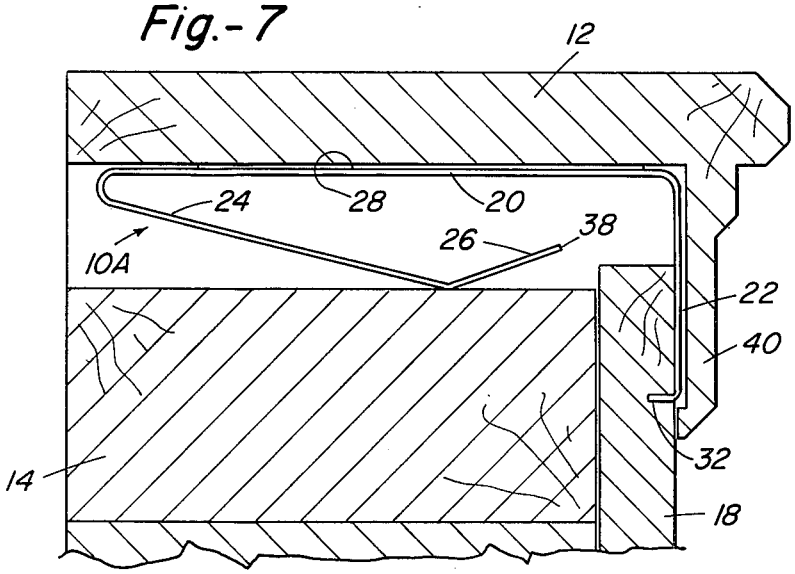
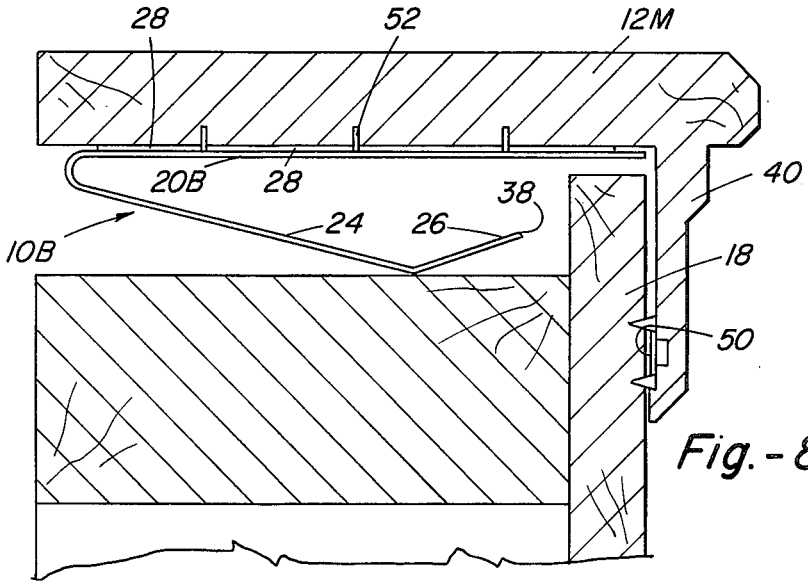
Fig.-8

SILL CLIP

Window sills, especially the residential type, are customarily set in place after the sash has been installed within the window opening although this may occur either before the drywall is up or after. The rough 2×4 horizontal frame members extend along the bottom of the sash and to the rear thereof to provide a platform or bench atop which the sill is mounted. Conventional practice is to leave a half inch or more extra space between the top surface of the rough frame and the bottom of the sill so that the latter can be adjusted and, perhaps, even tilted slightly before being fastened permanently in place. Traditionally, this gap is filled with shim stock of some sort, often pieces of wooden shingles, to support the sill in proper position with its front or leading edge snugged up tight against the bottom edge of the sash and the face-flange at the rear thereof flush against the drywall with the selected slope therebetween.

It has now been found in accordance with the teaching of the instant invention that a vastly superior system for installing window sills is possible by substituting specially-designed spring steel clips fastenable to the underside of the sill for the customary shims. These clips are easily fabricated from light gage spring steel strapping and, in their simplest form include only a horizontal leg fastenable in some convenient way as by double-faced adhesive strips to the underside of the sill, an integrally-formed spring finger extending rearwardly at an acute angle from the front end of the horizontal leg and an upturned foot on the rear end of the finger. The structure thus described is supplemented by some means for holding the rear edge of the sill down against the bias exerted by the clip therebeneath trying to raise it up. In most instances, such a fastening means consists of an integrally-formed vertical leg on the rear end of the horizontal one adapted to receive some type of separate fastening device such as a nail or adhesive. Alternatively, an integral toothed flange can be provided along the lower margin of the vertical flange extending forwardly. In the case of the post-drywall version of the clip, the vertical leg must be extra long so as to project beneath the bottom edge of the face-flange of the sill and thus remain accessible for nailing. In other versions of the clip, the fastening member is separate from the clip and is attached directly to the front face of the face-flange of the sill.

It is, therefore, the principal object of the present invention to provide a novel spring clip for holding window sills snug up against the bottom edge of a window sash.

A second objective is the provision of a device of the character described which is adaptable for use either before or after the drywall is installed.

Another object of the within described invention is to provide a biasing member effective to replace shims in raising and supporting a window sill in elevated position above the support therefor.

Still another objective of the clip device forming the subject matter hereof is to effect a considerable saving in time and labor usually associated with the installation of a window sill.

An additional object is to provide a spring sill clip that can, if desired, be cast integral with the sill.

Further objects are to provide a sill clip that is simple, inexpensive, easy to use, versatile, lightweight, compact, rugged, safe and even somewhat decorative.

Other objects will be in part apparent and in part pointed out specifically hereinafter in connection with the description of the drawings that follows, and in which:

FIG. 5 is a perspective view showing one form of toothed fastener mounted on the face-flange of the sill;

FIG. 6 is a sectional view to a much smaller scale than the other figures showing a sill equipped with the toothed fastener of FIG. 5;

FIG. 7 is a fragmentary cross section showing a completed assembly using the clip of FIG. 1;

FIG. 8 is a fragmentary cross section, portions of which have been broken away, showing a completed assembly using the clip of FIG. 4 with the sill and fastener subassembly of FIG. 6;

Figure 1:
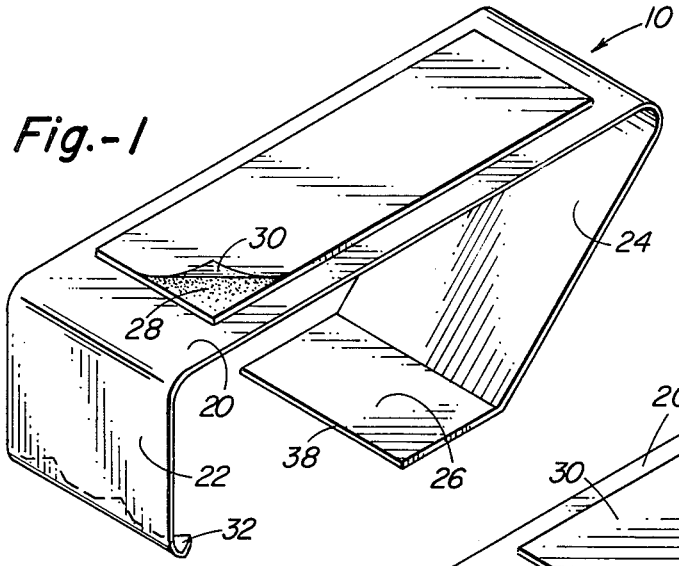
FIG. 1 is a perspective view of one of the post-drywall versions of the clip.

Referring next to the drawings for a detailed description of the present invention and, initially, to FIGS. 1 and 7 for this purpose, the basic version of the clip has been broadly designated by reference numeral 10 and it will be seen attached to the underside of a conventional cast ceramic sill 12 so as to hold the latter in the desired position above the rough frame member 14 after the sash 16 (FIG. 10) and the drywall 18 are both in place. Sill clip 10 is fabricated from a spring steel strap and it includes a horizontally-disposed leg 20, vertically-disposed leg 22 formed integral with the horizontal leg at what will be demonstrated here as the "near" end thereof, a spring finger 24 depending from the remote end of the horizontal leg extending rearwardly therefrom toward the horizontal leg at an acute angle terminating at its near or rear end in an upturned foot 26. Permanently fastened to the top of horizontal leg 20 of clip 10 is a short length of double-faced tape 28 having a removable tear strip 30 protecting the non-drying adhesive on the surface thereof. In the particular form shown in FIGS. 1 and 9, the lower edge of the vertical leg 22 is bent outwardly toward foot 26 and notched to produce integral toothed flange 32 adapted to enter the drywall panel 18 in the manner shown in FIG. 7.

In use, the tear strip 30 is first removed from the double-faced adhesive patch 28 atop the horizontal leg 20 and the entire clip 10 is stuck as shown in FIGS. 7–10, inclusive, onto the underside of the finished sill 12. In the modified version 10N shown in FIG. 10, vertical leg 22N is somewhat longer and has no toothed flange 32 at the lower end thereof. As thus modified, it differs from clip 10 of FIGS. 1 and 7 in that instead of being essentially nailed to the drywall panel as shown in FIG. 7, it is glued thereto by spreading a coat of quick-drying adhesive of some sort 36 which will be effective to bond same to the drywall.

Figure 10:
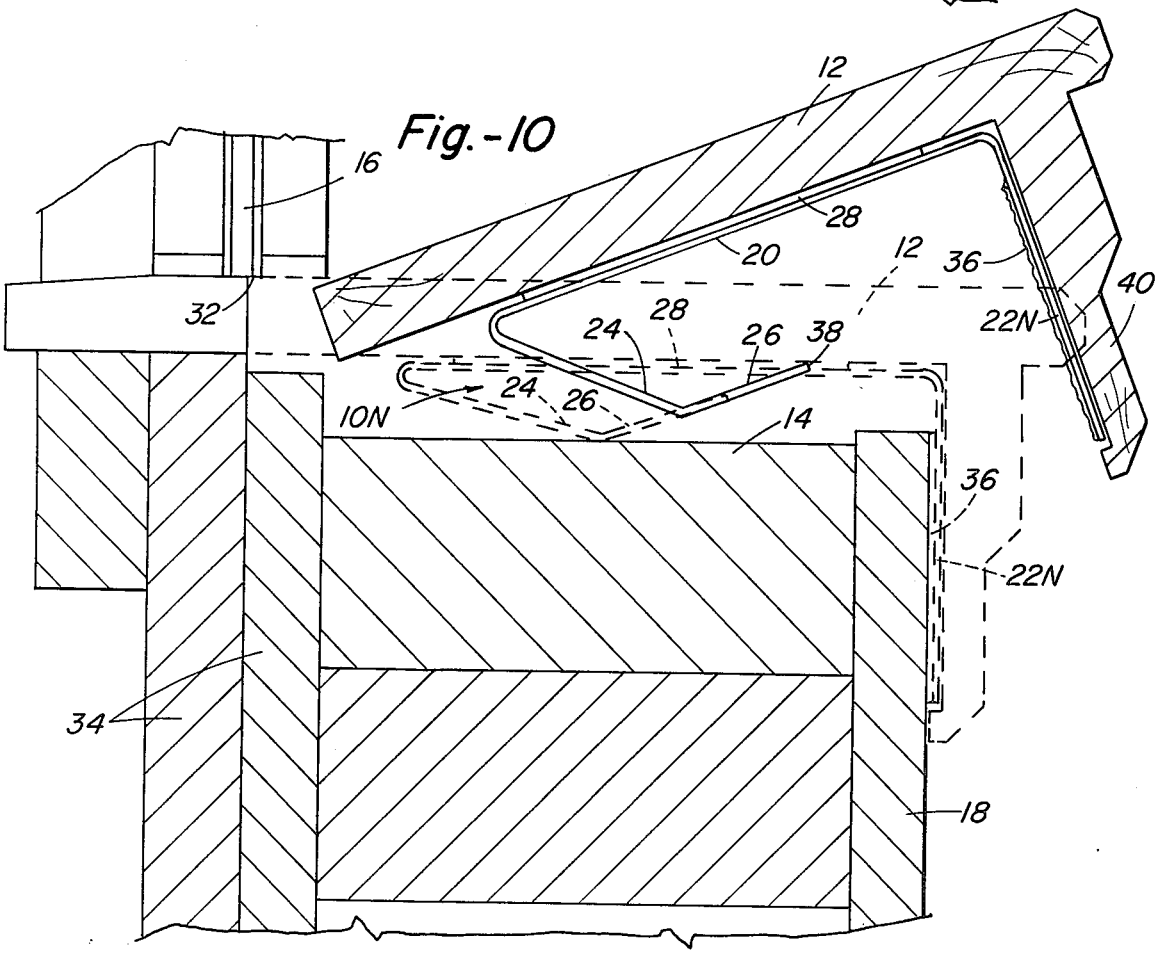

Sill clips 10 and 10N are both used after the drywall 18 is in place and their method of use is very similar. In FIG. 10, it can be seen that the sill with clip attached is first laid atop the 2×4 frame member 14 running along the bottom of the window opening in front of the sash 16. With the spring leg 24 thereof relaxed as shown in full lines, the front edge of the sill can be tilted and placed beneath bottom edge 32 of the sash as shown. In this tilted position, foot 26 on the end of the spring finger will tilt upwardly and rearwardly where it cannot dig into and hang upon the 2×4 frame. Tilting the rear end of the sill down into the essentially horizontal position shown in phantom lines will cause spring finger 24 to close to some degree assuming an even smaller acute angular relation to the horizontal leg thereof. In so doing, on the other hand, the spring leg has been compressed and is acting to bias the sill back up into its full line position. Note also, that when the spring leg is flexed as shown, the foot 26 on the end thereof stays in raised position to form a skid which allows the sill to be slid horizontally either forwardly or rearwardly without the end 38 catching on the frame member or otherwise hanging up in some fashion. It now becomes a simple matter to slide the front edge of the sill with the clip attached forwardly underneath the sill as indicated by the arrow while securing the face-flange 40 thereof to the front of the drywall panel 18 using either the toothed connector 32 or the adhesive 36 to maintain the sill in its proper position. No shims or other supports are required beneath the sill and with the spring leg 24 of the clip thus compressed, its foot 26 does not interfere in any way with movement of the sill to and fro as may be required to properly align and orient same.

Figure 2:
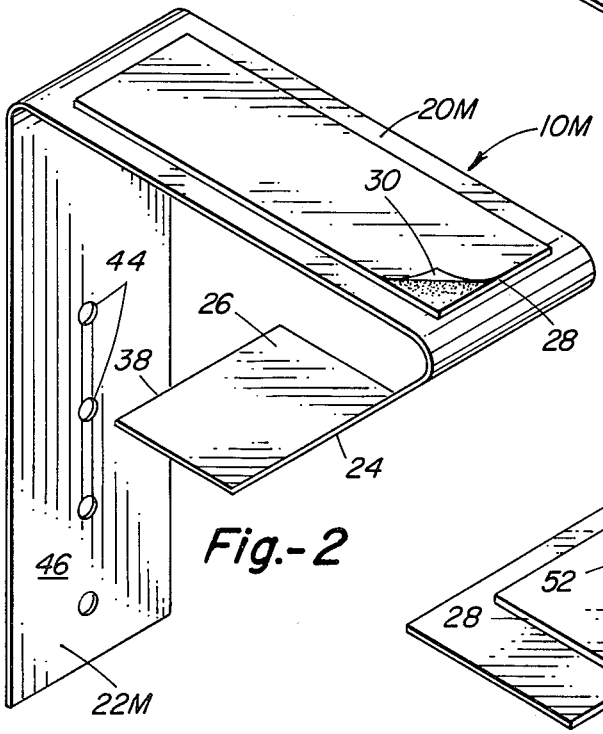
FIG. 2 is a perspective view showing a slightly modified post-drywall version of the clip having an apertured flange to receive nails in place of the integrally-formed toothed flange of FIG. 1.
Figure 9:
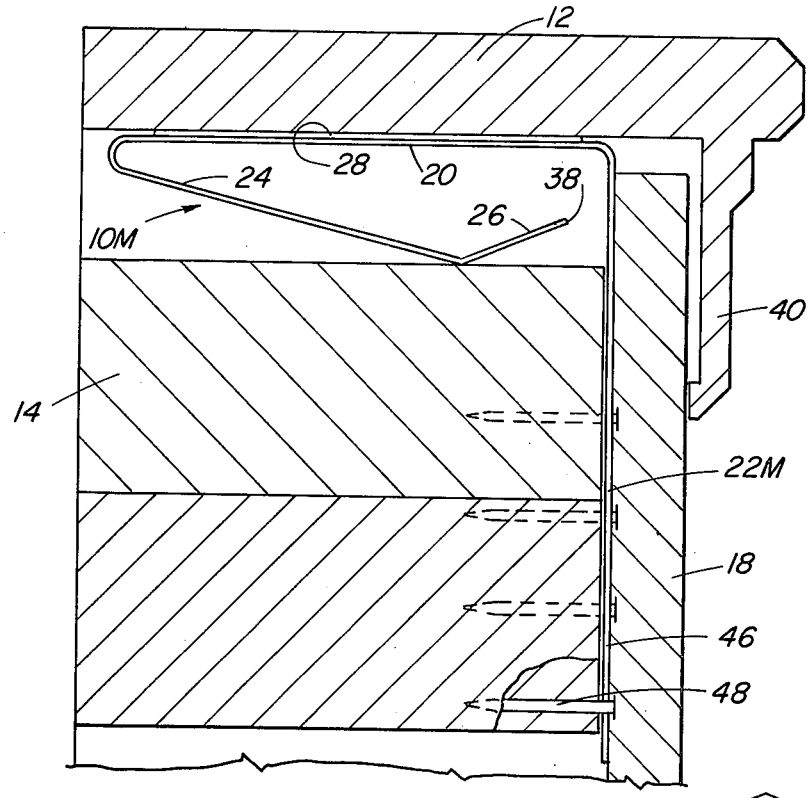
FIG. 9 is a fragmentary cross section showing a complete assembly using the clip of FIG. 2, portions having been broken away to more clearly reveal the interior construction; and, FIG. 10 is a fragmentary cross section revealing in full and phantom lines the progression of steps used in installation of a sill and sill clip like that of FIG. 1 but without the toothed flange using adhesives.

Another version of the clip 10M has been shown in FIGS. 2 and 9 designed primarily for use before the drywall 18 is in place. The primary differences between it and clips 10 and 10N lies in the vertical leg 22M which is a good deal longer and provided with nail-receiving apertures 44 (FIG. 2) located in the portion 46 projecting beneath the face-flange 40 of the sill. Horizontal leg 20M can conveniently be made somewhat shorter by approximately the thickness of the drywall panel 18 since the vertical leg will be nailed directly to the 2×4 frame members 14. The manner in which clip 10M is secured to the underside of the sill, lowered to compress the spring leg and slid forwardly into place beneath the sash remains essentially the same as previously described in connection with FIG. 10, except for the fact that the vertical leg 22M thereof is nailed directly to the frame members 14 using nails 48 rather than the adhesive or toothed flange 32 and the fact that vertical leg 22M must be spaced forwardly of face-flange 40 of the sill by the precise amount. Once the sill is installed as described above, the drywall can be nailed in place in the usual manner.

Figure 3:
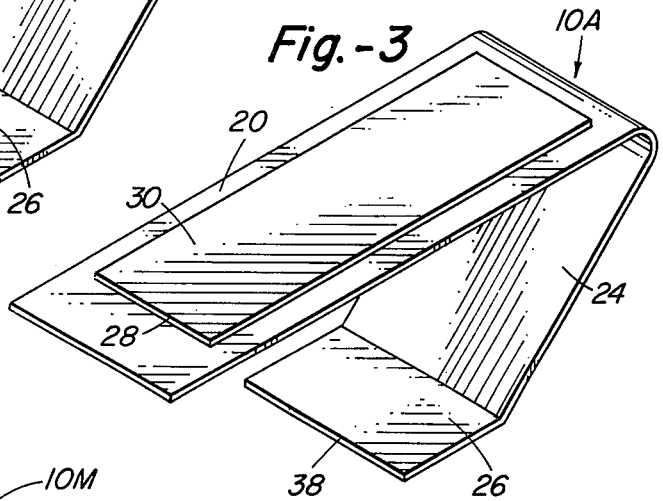
FIGS. 3 and 4 are both perspective views showing slightly different versions of spring clips designed for use with sills carrying their own independent fastening means for holding the rear edge of the sill down against the spring bias.

FIGS. 3–6, inclusive, to which detailed reference will next be made, show still other variations in the basic clip 10, these being denominated 10A and 10B with neither having any vertical leg 22. Version 10A shown in FIG. 3 is, in all other respects, substantially identical to clip 10 of FIG. 1; however, it is designed for use with a special molded plastic sill 12M shown in FIG. 6 which includes its own toothed fastener element 50 embedded in the face-flange 48 thereof. With the modified sill 12M carrying its own fastener element by means of which it can be secured to the drywall in the manner of FIG. 7, no need exists for vertical leg 22 or its appurtenances. Installation is, of course, exactly the same as previously set forth in FIG. 10.

Figure 4:
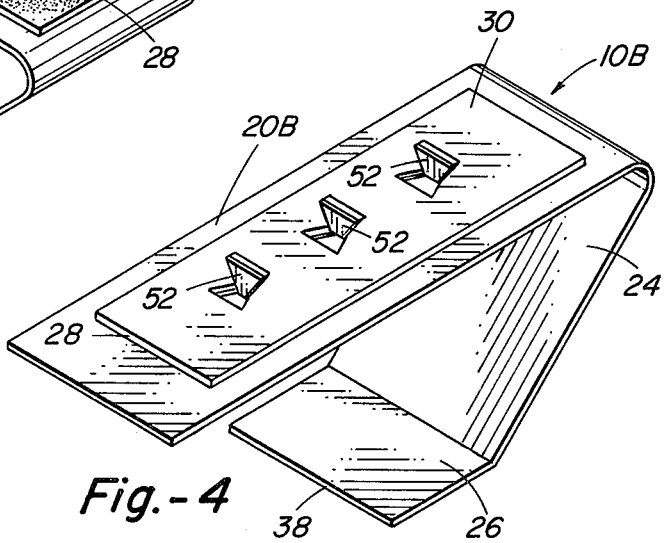

The only difference between clip 10A of FIG. 3 and 10B of FIG. 4 is the modification of horizontal leg 20B thereof to include punched integral tabs 52 which can be grouted or otherwise embedded as shown in FIG. 8 into the underside of the sill. As seen in FIGS. 4 and 8, a double-faced adhesive pad is still used to keep the clip in place while the grout dries. On the other hand, if tabs 52 are imbedded into the plastic out of which the sill is molded before it sets, then pad 28 would not be used.

FIG. 5 shows a simple punched metal fastener 50 of the type which could be used in imbedded condition to fasten the face-flange 40M of the poured sill to the drywall. Installation of clips 10A and 10B with poured sill 12M as shown in FIG. 8 is no different in any material respect than that which has already been described in connection with FIGS. 7 and 10.

What is claimed is:

1. For use in combination with a window sill of the type having a downwardly-directed flange along the rear edge thereof, a spring clip for biasing the sill up against the lower edge of a window sash from a horizontal support spaced therebeneath which comprises: a length of spring steel strap formed to provide an elongate horizontally-disposed leg of a length adapted to extend along the underside of the sill substantially from front to rear thereof, a double-faced adhesive pad attached to the top surface of the horizontal leg for fastening same to the underside of the sill, a spring finger depending from the front end of the horizontal leg extending downwardly and rearwardly therefrom at an acute angle, an upturned foot at the rear end of the spring finger cooperating therewith to define a skid adapted to permit rearward movement of the assembly including the clip and sill along the supporting surface therefor with the finger thereof compressed closer to the horizontal flange thereabove, and second fastening means for holding the rear end of the aforesaid assembly down in opposition to the lifting bias exerted thereon by the compressed finger.

2. The spring clip as set forth in claim 1 which includes a vertically-disposed leg depending from the rear end of the horizontal one.

3. The spring clip as set forth in claim 2 wherein a forwardly-extending toothed flange depends from the lower margin of the vertical flange.

4. The spring clip as set forth in claim 2 wherein the vertical flange is of a length adapted to project beneath the downwardly directed flange of the sill in assembled relation.

5. The spring clip as set forth in claim 4 wherein the portion of the vertical flange projecting beneath the downwardly directed flange of the sill is apertured to receive fasteners.

* * * * *